US006323159B1

(12) United States Patent
Raza

(10) Patent No.: US 6,323,159 B1
(45) Date of Patent: Nov. 27, 2001

(54) THERMOPLASTIC POLYURETHANE AND ADDITIVE PRODUCT AND PROCESS

(75) Inventor: Irfan F. Raza, Troy, MI (US)

(73) Assignee: U.S. Farathane Corporation, Sterling Heights, MI (US)

( * ) Notice: Subject to any disclaimer, the term of this patent is extended or adjusted under 35 U.S.C. 154(b) by 0 days.

(21) Appl. No.: 09/732,539

(22) Filed: Dec. 8, 2000

(51) Int. Cl.[7] ..... C10M 107/40
(52) U.S. Cl. ..... 508/100; 524/233
(58) Field of Search ..... 508/100–109

(56) References Cited

U.S. PATENT DOCUMENTS 4,945,126 * 7/1990 Crosby et al. ..... 524/507
5,415,791 * 5/1995 Chou et al. ..... 252/12
5,427,698 * 6/1995 Hirokawa et al. ..... 252/12.4
6,025,306 * 2/2000 Erdemir ..... 508/125
6,121,208 * 9/2000 Toyota ..... 508/106
6,159,909 * 12/2000 Konig ..... 508/108

* cited by examiner

*Primary Examiner*—Ellen M. McAvoy
(74) *Attorney, Agent, or Firm*—Lalos & Keegan

(57) ABSTRACT

A product and a process for using a resilient, self-lubricating, shaped product for use in minimizing friction when the surface of said product is in contact with a relatively movable surface comprising the composition of a thermoplastic polyurethane and an amide having the general formula:

RC(=0)NHR', wherein R is the residue of a saturated fatty acid and R' is the residue of an unsaturated fatty acid, said amide being intimately interspersed within said thermoplastic urethane for continual migration outwardly from said surface. The amide is preferably N-oleyl palmitamide.

20 Claims, No Drawings

THERMOPLASTIC POLYURETHANE AND ADDITIVE PRODUCT AND PROCESS

INTRODUCTION

The present invention relates to products and processes for minimizing friction between relatively moving surfaces. More particularly, the present invention relates to resilient, self-lubricating, shaped products for use in reducing friction when such product is in contact with a relatively movable surface. The present invention more specifically relates to a process and a product including thermoplastic urethane containing an intimately interspersed additive that is capable of continually migrating outwardly from the surface of the product to provide lubrication at the interface between surfaces of the product and a surface of a relatively movable adjacent object.

BACKGROUND OF THE INVENTION

In the field of products used by consumers today, unwanted sounds or other noises emanating from such a product create an unpleasant environment for the consumer. Such an unwanted noise is particularly noticeable in environments that include a resilient-like product coming in contact with a relatively movable hard surface such as a metal part. This relative movement generates friction between these surfaces that often leads to clearly audible sounds that simply may be referred to as "squeaks" by the general public. Of course it is recognized that lubrication between these contacting surfaces minimizes, if not removes, the friction and avoids any further unwanted noise or squeaks. However in many products, particularly those in the automobile industry, there are so many instances where the surface of a resilient product contacts a relatively moving metal surface that providing the necessary lubrication at the precise location of the friction is not only not practical but usually impossible.

In particular, it has been found that in the automotive vehicle field, inner stabilizer bar bushings for use with elongated stabilizer bars often generate unwanted noises and squeaking because of the inherent stabilizer bar torsional action that generates relative movement. Further, a front stabilizer bar and cushion, also used in the automotive vehicle field, functions to help manage the stabilizer bar's torsional, conical, radial and axial actions but which often have been found to generate noise and squeaking. In each of the above instances the part or element in contact with the metal surface must be sufficiently durable for the life of the vehicle.

Eliminating friction causing squeaks is not limited to the automotive field. Products that would relieve the unwanted squeaks attendant to the inherent friction arising from the incorporation of bushings or other cushion like resilient products, for example, that are in intimate contact with movable surfaces would clearly fill a huge void in the art. For instance, any contact between a resilient element and a hard metal surface is subject to producing a squeak that external grease or other lubricant may be difficult, if not impossible, to be provided in every location where such frictional contact may occur.

Accordingly, there is a significant practical need in the art for a resilient product such as a thermoplastic polyurethane that possesses self-lubricating capabilities to continually provide lubricant that has the effect of minimizing, reducing or even eliminating friction that would otherwise produce unwanted noises or squeaking.

SUMMARY OF THE INVENTION

A resilient, self-lubricating, shaped product and also the process for using the product to minimize friction when the surface of the product is in contact with a relatively movable surface by the use of an amide interspersed intimately within the thermoplastic urethane for continual migration outwardly from the surface of the product to provide continuous lubrication. The amide has the general formula:

$$RC(=O)NHR',$$

wherein R is the residue of a saturated fatty acid and R' is the residue of an unsaturated fatty acid.

DETAILED DESCRIPTION OF THE INVENTION

The product of the present invention may be of any shape, molded or extruded, cut or shaved in any manner. It is not important to the present invention what shape the product takes because its shape will be dictated solely by its end use. While typically the shape of the product of the present invention would be in the form of a bushing in a toroidal shape or it could be a flat planar pad shape. It must be understood that the present invention imposes no shape or dimensional restrictions on the product.

In any event, the principal end use of the product of the present invention will include one in which the product comes into contact with a relatively movable surface such as, for instance, in the automobile industry, a bushing for an inner stabilizer bar or an end cushion for a front stabilizer bar. These are merely two examples of a myriad number of shapes and sizes for which the present invention has found to be useful to minimize undesirable noises or squeaks that would arise between the product and a relatively movable metal surface that would normally create such friction as to generate these squeaking noises or other cacaphony of sound as are all so well known to automotive vehicle users.

The product of the present invention is a thermoplastic polyurethane that may be of conventional composition and well known in the art. Typically the product is formed from a polyether or polyester polyol derived conventional thermoplastic polyurethane that may for instance have a hardness of Shore D 30–70. The hardness level however is not critical.

Polyether or polyester polyols are the most common intermediate products in order to form the polyurethanes and it has been found that no particular polyether or polyester polyol based thermoplastic polyurethane is more significant or useful in producing the desired thermoplastic polyurethane. However, it has been found that the conventional source of hydroxyl such as, PTMEG (polytetramethylene ether glycol), when combined with the conventional isocyanate, MDI (diphenylmethane diisocyanate), and the typical short chain diol extender such as, 1,4-butanediol in the well known procedure would produce a typical thermoplastic polyurethane that is useful in the present invention. It should be understood that the essence of the present invention does not lie in the particular selection of the thermoplastic polyurethane.

The thermoplastic polyurethane alone, however, in whatever end use it would have wherein it would contact a relatively movable metal surface would inherently and necessarily produce some friction giving rise to undesirable noises such as squeaking. It is to prevent this squeaking that it is now been discovered that a particular additive formed intimately with the thermoplastic polyurethane produces a resilient, self-lubricating, shaped product that will minimize the friction that otherwise would occur upon contact of the product surface with the relatively movable metal surface. This minimizing of the friction and therefore the reduction or elimination of the squeaking noise occurs by reason of the migration, on a continual basis, of a lubricant out from the interstices of the thermoplastic polyurethane product onto the external surface of the product to provide continual lubrication at the interface between the thermoplastic polyurethane product and the relatively movable metal surface.

It has been found that incorporation into the thermoplastic polyurethane, in any well known conventional manner of introducing an additive into a thermoplastic polyurethane, of an amide having the general formula:

$$RC(=O)NHR',$$

wherein R is the residue of a saturated fatty acid and R' is the residue of an unsaturated fatty acid produces the surprising capability of reducing or eliminating the above described squeaks by producing a continual migration of the amide to the product's surface.

Suitable saturated fatty acids are those selected from the aliphatic radical group having the formula:

$$C_nH_{2n+1}—,$$

wherein n=5–32.

Suitable unsaturated fatty acids may be selected from the aliphatic radical group having the formula:

$$C_nH_{2n-1}—,$$

wherein n=2–21.

A listing of the suitable fatty acids are the following:

| | |
|---|---|
| caproic acid | $C_5H_{11}COOH$ |
| enanthylic | $C_6H_{13}COOH$ |
| caprylic | $C_7H_{15}COOH$ |
| pelargonic | $C_8H_{17}COOH$ |
| capric | $C_9H_{19}COOH$ |
| undecylic | $C_{10}H_{21}COOH$ |
| lauric | $C_{11}H_{23}COOH$ |
| tridecoic | $C_{12}H_{25}COOH$ |
| myristic | $C_{13}H_{27}COOH$ |
| pentadecanoic | $C_{14}H_{29}COOH$ |
| palmitic | $C_{15}H_{31}COOH$ |
| margaric | $C_{16}H_{33}COOH$ |
| stearic | $C_{17}H_{35}COOH$ |
| nondecylic | $C_{18}H_{37}COOH$ |
| arachidic | $C_{19}H_{39}COOH$ |
| behenic | $C_{21}H_{43}COOH$ |
| carnaubic | $C_{23}H_{47}COOH$ |
| hyenic | $C_{24}H_{49}COOH$ |
| carboceric | $C_{25}H_{51}COOH$ |
| cerotic | $C_{26}H_{53}COOH$ |
| lacceroic | $C_{31}H_{63}COOH$ |
| melissic | $C_{29}H_{59}COOH$ |
| montanic | $C_{28}H_{57}COOH$ |
| psyllic | $C_{32}H_{65}COOH$ |

Within the general formula the unsaturated fatty acids are the following:

| | |
|---|---|
| acrylic acid | $C_2H_3.COOH$ |
| butenic acids (crotonic, isocrotonic, vinylacetic and methylacrylic acid) | $C_3H_5.COOH$ |
| pentenic acids (tiglic, angelic and senecioic acid) | $C_4H_7.COOH$ |
| hexenic acids | $C_5H_9.COOH$ |
| teracrylic acid | $C_6H_{11}.COOH$ |

-continued

| | |
|---|---|
| hypogeic acid | $C_{15}H_{29}.COOH$ |
| oleic, elaidic acid | $C_{17}H_{33}.COOH$ |
| erucic, brassidic and behenic acid | $C_{21}H_{41}.COOH$ |

Of all the prospective possible combinations forming an amide included within the general formula specified above, one particular amide stands out as being significantly more desirable than any of the others and that amide is N-oleyl palmitamide.

The amide may be present in the weight ratio to the thermoplastic polyurethane of 3:97 to 8:92, desirably a ratio of 4:96 to 6:94 and more desirably, the ratio should be 4.5:95.5 to 5.5 to 94.5, but most desirably the ratio of 5:95 has been found ideal.

The theory behind the cause of the migration of the amide lubricant out from the interstices of the thermoplastic polyurethane is not understood and no particular theoretical presentations are even suggested. The fact is, however, that the lubricant in the form of the amide is held either mechanically or through electron bonding within the interstices of the thermoplastic polyurethane and it is continually released. Whether the release by reason of migration of the amide out from the interstices is continuous is not clear but the strong imperical evidence is that there is some continuous migration as the following example will demonstrate.

EXAMPLE I

The parts at the time of molding are dry looking. Once molded, they are then cured for a period of 16–24 hours @ 230 F (110 C) in an air-circulating oven. After a period of 1–2 weeks after post-cure, migration of the additive is noticed on the surface of the molded parts in the form of a thin whitish looking waxy film that actually is the amide lubricant. The amide lubricant could be wiped off from the surface of the parts by using a piece of cloth. It has been noticed that the amide lubricant reappears within a period of 24 hours.

EXAMPLE II

In one experiment, a piece of cloth was soaked in a solvent (acetone) and then used to wipe off the amide lubricant from the surface of the molded parts. The result was the same because after about 24 hours, the amide lubricant reappeared indicating that the migration of the amide lubricant is an ongoing process.

As was said previously the amide can be added to the base thermoplastic polyurethane resin by conventional methods. Among these methods are a) compounding and b) a reactive extrusion process.

EXAMPLE III

In the compounding process a twin screw corotating extruder is used. The amide, N-oleyl palmitamide, was fed in with the base thermoplastic polyurethane resin previously derived from the reaction of PTMEG (polytetramethylene ether glycol), MDI (diphenylmethane diisocyanate) and 1,4-butanediol. The resulting product was then pelletized dried and injection molded into a finished component product.

EXAMPLE IV

In a reactive extrusion process, the above chemicals such as PTMEG, MDI and 1,4-butanediol are liquid when heated to a temperature between 120° F. to 150° F., that could produce the thermoplastic polyurethane alone, are reacted together in the presence of the desired amide additive, N-oleyl palmitamide. This reaction occurs when these liquid chemicals are fed together into a twin screw extruder. The result is the thermoplastic polyurethane product of the present invention with the additive within the interstices of the thermoplastic polyurethane. This resultant product was then pelletized, dried and injection molded into a finished component.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

What is claimed is:

1. A resilient, self-lubricating, shaped product for use in minimizing friction when the surface of said product is in contact with a relatively movable surface comprising the composition of a thermoplastic polyurethane and an amide having the general formula:

$RC(=0)NHR'$, wherein R is the residue of a saturated fatty acid and R' is the residue of an unsaturated fatty acid, said amide being intimately interspersed within said thermoplastic urethane for continual migration outwardly from said surface.

2. The product of claim 1 wherein, the residue of the saturated fatty acid is selected from the aliphatic radical group having the formula:

$C_nH_{2n+1}$—, wherein n=5–32.

3. The product of claim 1 wherein the residue of the unsaturated fatty acid is selected from the aliphatic radical group having the formula:

$C_nH_{2n-1}$—, wherein n=2–21.

4. The product of claim 1 wherein, the residue of the saturated fatty acid is selected from the aliphatic radical group having the formula:

$C_nH_{2n+1}$—, wherein n=5–32, the residue of the unsaturated fatty acid is selected from the aliphatic radical group having the formula:

$C_nH_{2n+1}$—, wherein n=2–21.

5. The product of claim 1 wherein, the amide is N-oleyl palmitamide.

6. The process of providing a continuous layer of lubricant between a thermoplastic polyurethane product and a relatively movable surface to minimize friction and preventing squeak noises comprising, incorporating an amide having the general formula:

$R\ C(=O)NHR'$ wherein R is the residue of a saturated fatty acid and R' is the residue of an unsaturated fatty acid, said amide being intimately interspersed within said thermoplastic urethane for continual migration outwardly from said surface.

7. The process of claim 6 wherein, the residue of the saturated fatty acid is selected from the aliphatic radical group having the formula:

$C_nH_{2n+1}$—, wherein n=5–32.

8. The process of claim 6 wherein, the residue of the unsaturated fatty acid is selected from the aliphatic radical group having the formula:

$C_nH_{2n-1}$—, wherein n=2–21.

9. The process of claim 6 wherein, the residue of the saturated fatty acid is selected from the aliphatic radical group having the formula:

$C_nH_{2n+1}$—, wherein n=5–32, the residue of the unsaturated fatty acid is selected from the aliphatic radical group having the formula:

$C_nH_{2n-1}$—, wherein n=2–21.

10. The process of claim 6 wherein, the amide is N-oleyl palmitamide.

11. The product of claim 1 wherein, the amide is present in the weight ratio to the thermoplastic polyurethane of 3:97 to 8:92.

12. The product of claim 11 wherein, the ratio is 4:96 to 6:94.

13. The product of claim 11 wherein the ratio is 4.5:95.5 to 5.5 to 94.5.

14. The product of claim 11 wherein, the amide is N-oleyl palmitamide, the ratio is about 5:95.

15. The process of claim 6 wherein, the residue of the saturated fatty acid is selected from the aliphatic radical group having the formula:

$C_nH_{2n+1}$—, wherein n=5–32, the amide is present in the weight ratio to the thermoplastic polyurethane of 3:97 to 8:92.

16. The process of claim 6 wherein, the residue of the unsaturated fatty acid is selected from the aliphatic radical group having the formula:

$C_nH_{2n-1}$—, wherein n=2–21, the amide is present in the weight ratio to the thermoplastic polyurethane of 3:97 to 8:92.

17. The process of claim 6 wherein, the residue of the saturated fatty acid is selected from the aliphatic radical group having the formula:

$C_nH_{2n+1}$—, wherein n=5–32, the residue of the unsaturated fatty acid is selected from the aliphatic radical group having the formula:

$C_nH_{2n-1}$—, wherein n=2–21, the amide is present in the weight ratio to the thermoplastic polyurethane of 3:97 to 8:92.

18. The process of claim 6 wherein, the residue of the saturated fatty acid is selected from the aliphatic radical group having the formula:

$C_nH_{2n+1}$—, wherein n=5–32, the residue of the unsaturated fatty acid is selected from the aliphatic radical group having the formula:

$C_nH_{2n-1}$—, wherein n=2–21, the ratio is 4:96 to 6:94.

19. The process of claim 6 wherein, the amide is N-oleyl palmitamide, the ratio is 4.5:95.5 to 5.5:94.5.

20. The process of claim 6 wherein, the amide is N-oleyl palmitamide, the ratio is about 5:95.

* * * * *

UNITED STATES PATENT AND TRADEMARK OFFICE

CERTIFICATE OF CORRECTION

PATENT NO. : 6,323,159 B1
DATED : November 27, 2001
INVENTOR(S) : Irfan F. Raza

It is certified that error appears in the above-identified patent and that said Letters Patent is hereby corrected as shown below:

Column 5,
Line 55, delete formula "$C_nH_{2n+1}$–" replace with -- $C_nH_{2n-1}$–" --

Column 7,
Line 5, delete "the ratio is" replace with -- "the amide is present in the weight ratio to the thermoplastic polyurethane of"--

Column 8,
Line 8, delete "the ratio is" replace with -- "the amide is present in the weight ratio to the thermoplastic polyurethane of" --.
Line 11, delete "the ratio is" replace with -- "the amide is present in the weight ratio to the thermoplastic polyurethane of" --

Signed and Sealed this

Eleventh Day of June, 2002

*Attest:*

*Attesting Officer*

JAMES E. ROGAN
*Director of the United States Patent and Trademark Office*